United States Patent [19]

Ohki et al.

[11] Patent Number: 4,530,899

[45] Date of Patent: Jul. 23, 1985

[54] COLOR PHOTOGRAPHIC MATERIALS WITH PHENOL OR NAPHTHOL RING COMPOUND HAVING SULFOAMIDO GROUP

[75] Inventors: Nobutaka Ohki; Nobuo Furutachi; Yoshinobu Yoshida, all of Kanagawa, Japan

[73] Assignee: Fuji Photo Film Co., Ltd., Kanagawa, Japan

[21] Appl. No.: 601,760

[22] Filed: Apr. 18, 1984

[30] Foreign Application Priority Data

Apr. 19, 1983 [JP] Japan ..... 58-68878

[51] Int. Cl.[3] ..... G03C 1/06; G03C 7/00; G03C 7/34

[52] U.S. Cl. ..... 430/551; 430/372; 430/542

[58] Field of Search ..... 430/551, 372, 542

[56] References Cited

U.S. PATENT DOCUMENTS 4,366,226 12/1982 Hamaoka et al. ..... 430/551 X 4,447,523 5/1984 Ross et al. ..... 430/551 X

*Primary Examiner*—John E. Kittle

*Assistant Examiner*—Mukund J. Shah

*Attorney, Agent, or Firm*—Sughrue, Mion, Zinn Macpeak & Seas

[57] ABSTRACT

A color photographic material containing, as a color stain preventing agent, a substantially colorless phenol and/or naphthol derivative having a group which is not released by displacement of the oxidation product of an aromatic primary amine color developing agent at the 4-position thereof and at least one sulfonamido group and at least one sulfonamido group, acylamino group or sulfonyl group at other positions of the ring. The color stain preventing agent very effectively removes the oxidation product of a color developing agent at color development and maintain the effect for a long period of time.

11 Claims, No Drawings

COLOR PHOTOGRAPHIC MATERIALS WITH PHENOL OR NAPHTHOL RING COMPOUND HAVING SULFOAMIDO GROUP

FIELD OF THE INVENTION

This invention relates to a color photographic material where color stains are prevented, and in particular to a silver halide color photographic material containing a sulfonamidophenol derivative as a color stain preventing agent.

BACKGROUND OF THE INVENTION

It is well known in a multicolor photographic material of the type that color-forming couplers are present in silver halide photographic light-sensitive emulsions and developed using a color developing agent such as p-phenylenediamine, etc., that the oxidation product of a color developing agent transfers into an adjacent image-forming layer to form an undesirable dye, i.e., a so-called "color turbidity" (color mixing) phenomenon. It is also known that an undesirable "color fog" phenomenon occurs due to air oxidation of a color developing agent and the fog of silver halide emulsions at color development. Hereinafter, "color turbidity" and "color fog" are generally called "color stain".

The use of various kinds of hydroquinones has hitherto been proposed to prevent the formation of color stain. For example, the use of mono-straight chain alkylhydroquinones is described in U.S. Pat. No. 2,728,569; Japanese Patent Publication (Unexamined) No. 106,329/'74, etc., and the use of mono-branched alkyl hydroquinones is described in U.S. Pat. No. 3,700,453; West German Patent Application (OLS) No. 2,149,789; Japanese Patent Publication (Unexamined) No. 156,438/'75, etc. Also, the use of di-straight chain alkyl hydroquinones is described in U.S. Pat. Nos. 2,728,657 and 2,732,300; U.K. Pat. Nos. 752,146 and 1,086,208; *Chemical Abstracts,* Vol. 58, 6367h, etc., and the use of dibranched alkyl hydroquinones is described in U.S. Pat. Nos. 3,700,453 and 2,732,300; U.K. Pat. No. 1,086,208; *Chemical Abstracts,* Vol. 58, 6367h, Japanese Patent Publication (Unexamined) No. 156,438/'75; Japanese Patent Publication Nos. 21,249/'75; 40,818/'81, etc. Furthermore, the use of alkyl hydroquinones as color stain preventing agents is described in U.K. Pat. Nos. 558,258; 557,750 (corresponding to U.S. Pat. No. 2,360,290); 557,802; 731,301 (corresponding to U.S. Pat. No. 2,701,197); U.S. Pat. Nos. 2,336,237; 2,403,721; and 3,582,333; West German Patent Application (OLS) No. 2,505,016 [corresponding to Japanese Patent Publication (Unexamined) No. 110,337/'759; and Japanese Patent Publication No. 40,816/'81.

It is known that the "color turbidity" phenomenon occurs in color diffusion transfer photographic materials as in ordinary color photographic materials and to prevent the occurrence of the color turbidity, the foregoing hydroquinones are used. Hydroquinones used as a color turbidity preventing agent for color diffusion transfer photographic materials are described in Japanese Patent Publication (Unexamined) No. 21,249/'83.

Moreover, the use of sulfonamidophenols as a color turbidity preventing agent for color diffusion transfer photographic materials is described in *Research Disclosure,* 15162 (1973), page 83; Japanese Patent Publication (Unexamined) Nos. 72,158/'80 and 24,941/'82 (corresponding to U.S. Pat. No. 4,366,226).

Recently, in producing color photographic materials, it has been strongly desired for obtaining high quality color photographs to develop a new color stain preventing agent which more effectively prevents the occurrence of color stain without reducing the photographic sensitivity, which can be incorporated in a photographic material having thinner photographic layers for improving the sharpness of images formed, does not change the property thereof when it is stored for a long period of time, and further contributes to the improvement of the light fastness of dye images formed by color development.

SUMMARY OF THE INVENTION

A first object of this invention is to provide a novel color stain preventing agent.

A second object of this invention is to provide a novel color stain preventing agent capable of removing the oxidation product of a color developing agent or a charge-transfer type black and white developing agent with a good efficiency.

A third object of this invention is to provide a novel color stain preventing agent capable of constituting a photographic material with thinner photographic layers.

A fourth object of this invention is to provide a novel color stain preventing agent which does not change the property thereof when it is stored for a long period of time.

A fifth object of this invention is to provide a color photographic material containing the novel color stain preventing agent.

The silver halide photographic material of the present invention comprises a support and at least one silver halide emulsion layer on the support, which contains at least one compound selected from the group consisting of a substantially colorless phenol and naphthol derivative having a group which is not released by the displacement of the oxidation product of an aromatic primary amine at the 4-position of the phenol ring or the naphthol ring of the derivative and at least one sulfonamido group and at least one group selected from the group consisting of a sulfonamido group, an acrylamino group, and a sulfonyl group at other positions of the phenol or naphthol ring.

By the term "substantially colorless" is meant that the derivative has no or less absorption to light having wave lengths in a visible wave length region and does not take part in the formation of color images.

DESCRIPTION OF THE PREFERRED EMBODIMENT

The color stain preventing agent of this invention is preferably the compound represented by the general formula (I)

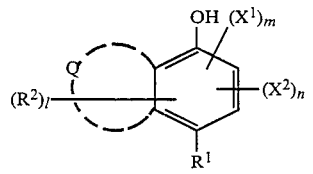

(I)

wherein $X^1$ and $X^2$ each represents a sulfonamido group, an acylamino group or a sulfonyl group; at least one of $X^1$ and $X^2$ being an sulfonamido group; $R^1$ represents a group which is not released by displacement of the oxidation product of an aromatic primary amine; $R^2$ represents a halogen atom, a cyano group, a nitro group, an alkyl group, an aryl group, a heterocyclic ring group, an alkoxy group, an aryloxy group, an alkylthio group, an arylthio group, a heterocyclic thio group, a carbamoyl group, an alkoxycarbonyl group, an acyl group, an alkoxycarbonylamino group, a ureido group, an amino group, a sulfinul group or the foregoing group represented by $X^1$ and $X^2$; l represents 0, 1 or 2; the ring having the OH group as the substituent is a benzene ring or a naphthalene group formed by the atomic group Q with the benzene ring, and m and n each represents an integer of 1 to 3.

The sulfonamido group represented by $X^1$ and $X^2$ preferably has 1 to 30 carbon atoms and examples of suitable sulfonamido groups are a methanesulfonamido group, a benzenesulfonamido group, a 4-dodecylbenzenesulfonamido group, a tetradecanesulfonamido group, a 2,4-di-t-amylbenzenesulsonamido group, a 4-(2-ethylhexyloxy)benzenesulfonamido group, a 2-butyloxy-5-t-octylbenzenesulfonamido group, etc. The acylamino group shown by $X^1$ and $X^2$ preferably has 2 to 30 carbon atoms and suitable examples of acylamino groups are an acetylamino group, a benzamido group, a trifluoroacetamido group, a 4,4,4,3,3,2,2-heptafluorobutaneamido group, a 2,3,4,5,6-pentafluorobenzamido group, a (2,4-di-t-amylphenoxy)acetamido group, etc. Also, the sulfonyl group represented by $X^1$ and $X^2$ preferably has 1 to 30 carbon atoms and suitable examples of sulfonyl groups are a methanesulfonyl group, a dodecanesulfonyl group, a benzenesulfonyl group, a 4-octyloxybenzenesulfonyl group.

The group represented by $R^1$, which is not released by the displacement of the oxidation product of an aromatic primary amine, includes an alkyl group (preferably having 1 to 20 carbon atoms, such as a methyl group, a t-butyl group, etc.), an alkoxycarbonyl group (preferably having 2 to 20 carbon atoms, such as a methoxycarbonyl group, a butoxycarbonyl group, etc.), an acyl group (preferably having 2 to 20 carbon atoms, such as an acetyl group, a benzoyl group, etc.), a carbamoyl group (preferably having up to 20 carbon atoms, such as an N,N-dimethylcarbamoyl group, an N-phenylcarbamoyl group, an N-methylcarbamoyl group, etc.), a sulfamoyl group (preferably having up to 20 carbon atoms, such as an N,N-diethylsulfamoyl group, an N-phenylsulfamoyl group, etc.), a sulfonyl group (preferably having 1 to 20 carbon atoms, such as methanesulfonyl group, a benzenesulfonyl group, etc.), an aryl group (preferably having ≢to 20 carbon atoms, such as a phenyl group, a p-tolyl group, etc.), a heterocyclic group linked through a carbon atom (such as, a 2-furyl group, a 2-thienyl group, etc.), etc. These groups may also be substituted.

$R^2$ in general formula (I) can be a halogen atom (e.g., a chlorine atom, a bromine atom, etc.), a cyano group, a nitro group, an alkyl group (the alkyl group may be a straight chain, branched or cyclic alkyl group, includes the alkyl groups having various substituents such as a halogen atom, an aryl group, an alkoxy group, an aryloxy group, a sulfonyl group, a sulfonamido group, etc., and preferably has 1 to 30 carbon atoms. Examples of suitable alkyl groups are a methyl group, an ethyl group, a t-butyl group, a n-octyl group, a t-pentyl group, a dodecyl group, a benzyl group, a cyclopentyl group, a 2-methanesulfonylethyl group, a pentadecyl group, etc.), an aryl group (including aryl groups with various substituents such as halogen atom, an alkyl group, an alkoxy group, an amido group, etc., preferably having 6 to 30 carbon atoms, such as a phenyl group, a naphthyl group, a 2-chlorophenyl group, a 2,4-di-t-amylphenyl group, a 3-acetamidophenyl group, etc.), a heterocyclic group (e.g., a 2-furyl group, a 2-thienyl group, a 1-piperidino group, a 2-benzotriazolyl group, etc.), an alkoxy group (which may be a straight chain, branched or cyclic alkoxy group, including alkoxy groups having various substituents such as a halogen atom, an amido group, a heterocyclic group, an aryl group, a sulfonyl group, etc., and preferably having 6 to 30 carbon atoms, such as a methoxy group, a dodecyloxy group, a 2-ethylhexyloxy group, a cyclopentyloxy group, a 2-acetamidoethyloxy group, a 4-methanesulfonylbutyloxy group, a 2-tetrahydropyranyloxy group, etc.), an aryloxy group (including those having a substituent such as a halogen atom, an alkyl group, an alkoxy group, an amido group, etc., and preferably having 6 to 30 carbon atoms, such as a phenoxy group, etc.), an alkylthio group (which may be a straight chain, branched or cyclic alkylthio group including alkylthio groups having various substituents such as a halogen atom, an aryl group, an alkenyl group, etc., and preferably has 1 to 30 carbon atoms, such as a methylthio group, a dodecylthio group, a 3-phenylpropylthio group, a 2-(2,4-di-t-amylphenoxy)ethylthio group, etc.), an arylthio group (including those having a substituent such as a halogen atom, an alkyl group, an alkoxy group, an amido group, etc., and preferably having 6 to 30 carbon atoms, such as a phenylthio group, a 2-butyloxy-5-t-octylphenylthio group, etc.), a heterocyclic thio group (e.g., a 1,3-benzothiazole-2-thio group, a 2-pyridylthio group, a 1-phenyltetrazolyl-5-thio group, etc.), a carbamoyl group (including mono- or di-substituted carbamoyl groups and having preferably 1 to 20 carbon atoms, such as an N-methylcarbamoyl group, an N,N-diethylcarbamoyl group, an N-phenylcarbamoyl group, an N-methyl-N-phenylcarbamoyl group, etc.), an alkoxycarbonyl group (including those having a substituent such as halogen atom, an aryl group, etc., and preferably having 2 to 20 carbon atoms, such as a methoxycarbonyl group, etc.), an acyl group (preferably having 2 to 20 carbon atoms, such as an acetyl group, a benzoyl group, a 2-hydroxybenzoyl group, etc.), an alkoxycarbonylamino group (including those having a substituent each as a halogen atom, an aryl group, etc., and preferably having 2 to 20 carbon atoms, such as a methoxycarbonylamino group, a dodecylcarbonylamino group, etc.), a ureido group (including those substituted with an alkyl group, an aryl group, etc., and preferably having 1 to 20 carbon atoms, such as an N-methylureido group, an N-phenylureido group, an N,N-dimethylureido group, etc.), an amino group (including mono- or di-substituted amino groups and preferably having up to 30 carbon atoms, such as an amino group, an N-methylamino group, an N,N-dimethylamino group, an N-phenylamino group, a 2,4-dichloroanilino group, an N-morpholino group, etc.), a sulfinyl group (preferably having 1 to 20 carbon atoms, such as a methanesulfinyl group, a benzenesulfinyl group, etc.) or the group represented by $X^1$ and $X^2$.

Of the compounds represented by general formula (I) described above, the compounds represented by the following general formula (II) or (III) are preferred:

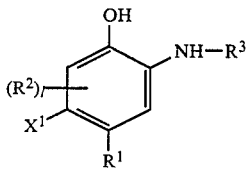

(II)

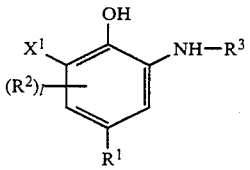

(III)

wherein $R^1$, $R^2$, and l have the same meaning as defined in general formula (I), $X^1$ represents a sulfonamido group, an acylamino group and a sulfonyl group, and $R^3$ represents a sulfonyl group (e.g., a benzenesulfonyl group, a 4-dodecyloxybenzenesulfonyl group, a 4-(2-ethylhexyloxy)benzenesulfonyl group, a 4-dodecylbenzenesulfonyl group, a methanesulfonyl group, an octanesulfonyl group, a tetradecanesulfonyl group, a 2-(2,4-di-tert-amylphenoxy)ethanesulfonyl group, a 4-(dodecyloxy)butanesulfonyl group, etc.). Compounds represented by formula (II) are especially preferred.

The compound of general formula (II) or (III) with the total number of carbon atoms in $X^1$, $R^1$, $R^2$ and $R^3$ of over 10 has a high diffusion resistance property and is particularly preferred.

When the compound of this invention is used in an interlayer of a color photographic material as a color turbidity preventing agent, the compound is preferably used in an amount of about $5\times10^{-3}$ to about $5\times10^{-6}$ mole/m$^2$ and more preferably about $1.0\times10^{-3}$ to about $1.0\times10^{-5}$ mole/m$^2$ per layer and when the compound of this invention is used in a silver halide emulsion layer of a color photographic material as a color fog preventing agent, the compound is preferably used in an amount of about $5\times10^{-4}$ to about $5\times10^{-7}$ mole/m$^2$, and more preferably about $1.0\times10^{-4}$ to about $1.0\times10^{-6}$ mole/m$^2$ per layer. Furthermore, the compound can be incorporated in both the interlayer and the silver halide emulsion layer of a color photographic material as a color turbidity preventing agent and a color fog preventing agent.

Specific examples of the compound of this invention are shown below but the invention is not to be construed as being limited to these compounds.

(1)

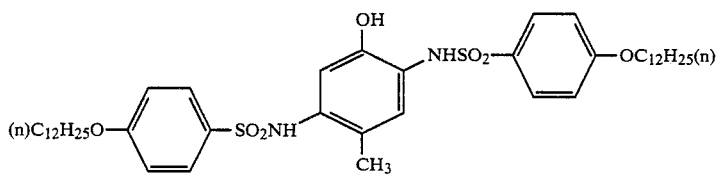

(2)

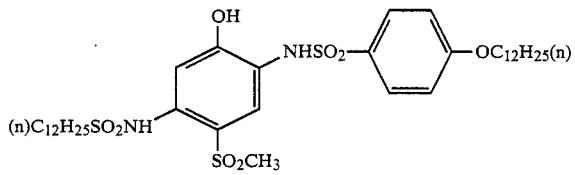

(3)

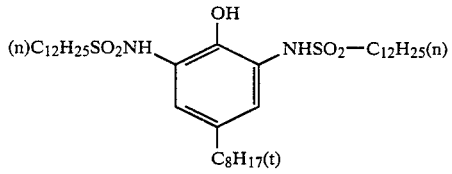

(4)

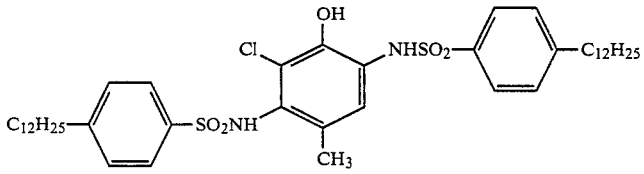

(5)

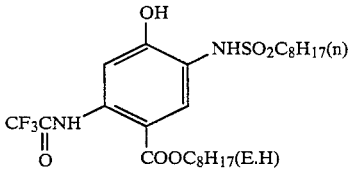

(E.H: 2-ethylhexyl)

-continued
(6)
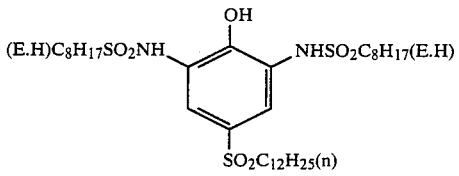
(7)
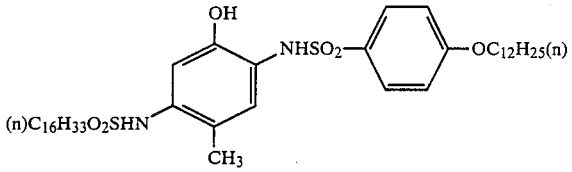
(8)
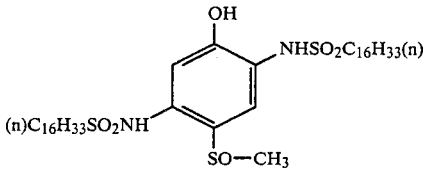
(9)
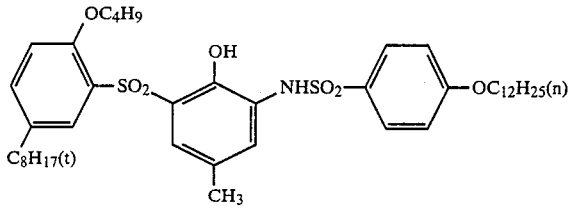
(10)
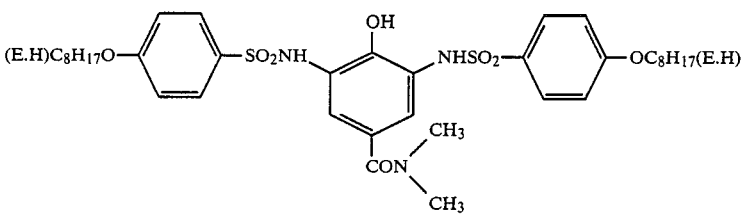
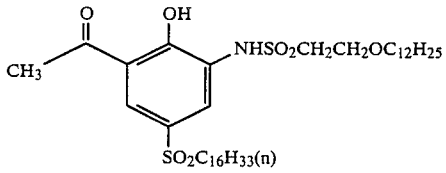
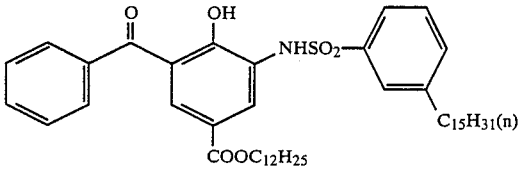
(11)
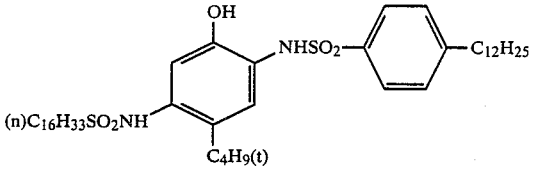

-continued
(12)
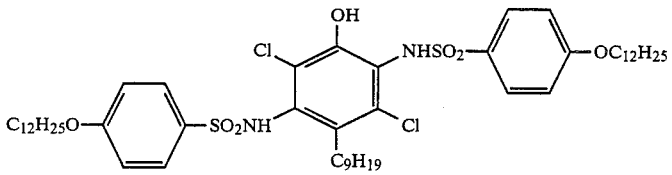
(13)
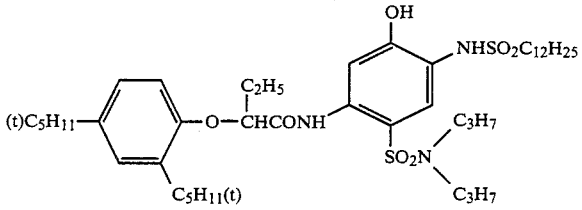
(14)
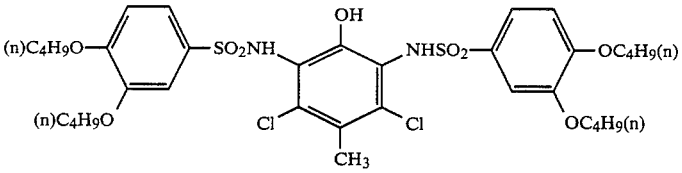
(15)
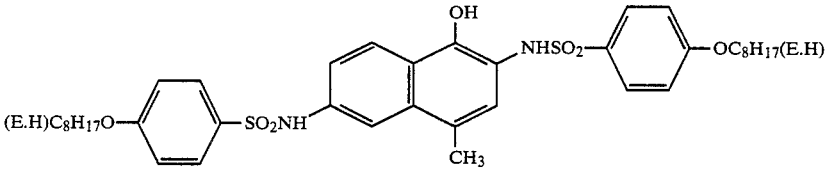
(16)
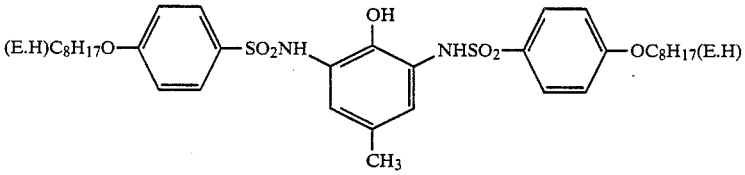
(17)
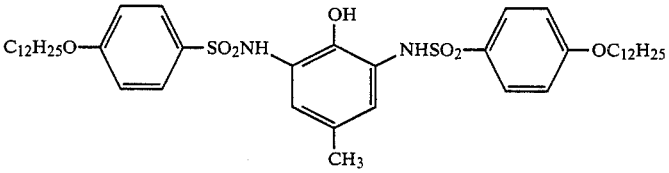
(18)
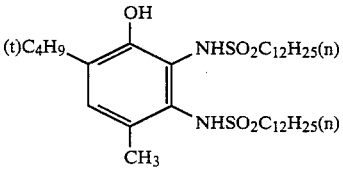
(19)
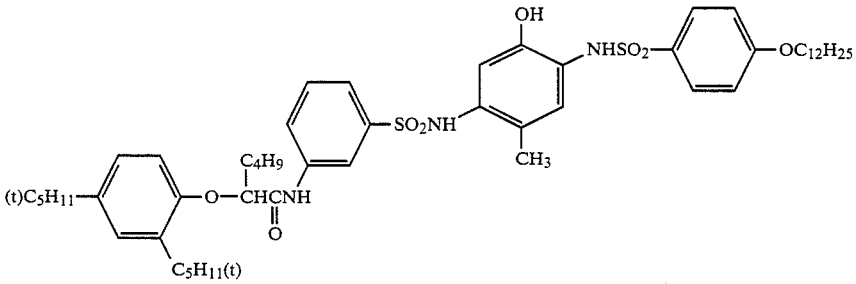

-continued

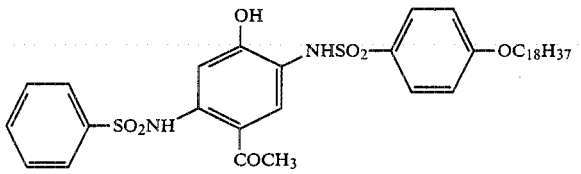

(20)

The compounds of this invention can be generally prepared by the following two synthesis routes or modifications thereof.

Route A:

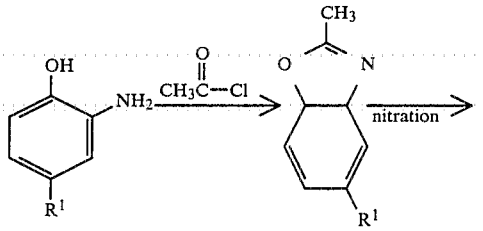

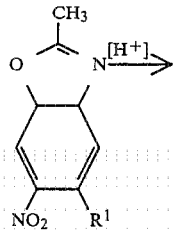

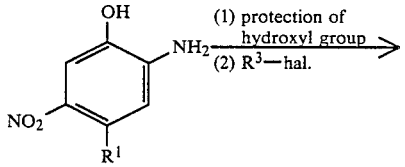

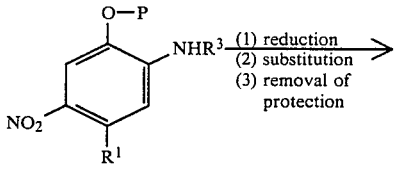

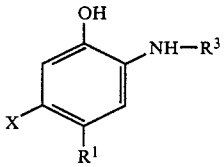

Route B:

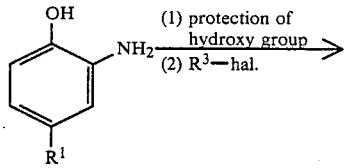

-continued

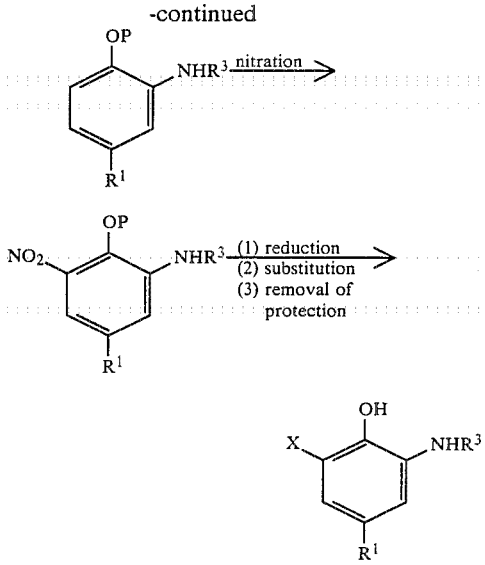

wherein $R^1$ and X have the same meaning as defined above; P represents a group known as a protective group for a hydroxy group (e.g., a benzyl group, a phenacyl group, a tetrahydropyranyl group, etc.); in these routes, the protection of a hydroxy group may be omitted depending on the kind of compound; and "hal" is a halogen atom, such as a chlorine atom and a bromine atom. With respect to the starting materials there is a disclosure, for example, in Beilstein, *Handbuch der Organischen Chemie* (*Handbook of Organic Chemistry*) Vol. 13, p. 601.

The following specific synthesis examples are given to illustrate preparation of the compounds of this invention. Unless otherwise indicated herein, all parts, percents, ratios and the like are by weight.

SYNTHESIS EXAMPLE 1

Synthesis of Compound (1)

In 200 ml of dimethylformamide was dissolved 16.8 g of a starting material shown in the general synthesis method, 2-amino-4-methyl-5-nitrophenol, and 5 g of sodium hydride (oil dispersion containing 50% sodium hydride) was gradually added to the solution at room temperature under a nitrogen gas atmosphere. After evolution of hydrogen gas had stopped, 18 g of benzyl bromide was added dropwise and the resultant mixture was stirred for 2 hours at 40° C. After cooling, ice water was added to the reaction mixture and the solids thus precipitated were collected by filtration and dried well.

The solids (15 g) was dissolved in a mixture of 50 ml of tetrahydrofuran and 50 ml of pyridine without purification and then 18 g of 4-dodecyloxybenzenesulfonyl chloride was added to the solution followed by stirring for 2 hours at room temperature (about 20°-30° C.).

Then, the product was extracted with the addition of 300 ml of ethyl acetate and 50 ml of acetic acid. The organic layer thus formed was collected, washed twice each time with a saturated sodium chloride aqueous solution, and the ethyl acetate layer was dried over anhydrous sodium sulfate. The solvent was removed at reduced pressure from the solution and the residue was crystallized from acetonitrile to provide 25.1 of [2-(4-dodecyloxybenzenesulfonamido)-4-methyl-5-nitrophenyl]benzyl ether (Intermediate Product A).

In 200 ml of isopropanol was suspended 25 of Intermediate Product A, and after further adding 20 ml of water, 2 g of ammonium chloride, and 20 g of reduced iron to the suspension, the resultant mixture was refluxed for one hour under a nitrogen stream. After confirming the end of the reaction by thin layer chromatography, the reaction mixture was filtered under heating through a Celite base. The filtrate was concentrated and the residue was employed in the following step without purification. That is, the residue was dissolved in a mixture of 50 ml of tetrahydrofuran and 50 ml of pyridine, and in the same manner as in preparation of Intermediate Product A, 14 g of 4-dodecyloxybenzenesulfonyl chloride was added to the solution and after the reaction was finished, the reaction mixture was post treated to obtain 29.0 g of the powder of [4-methyl-2,5-bis(4-dodecyloxybenzenesulfonamido)phenyl]benzyl ether (Intermediate Product B).

Then, 28 g of Intermediate Product B was dissolved in 200 ml of tetrahydrofuran and after adding thereto 2.8 g of palladium-carbon (10%), the mixture was hydrogenated for one day in an autoclave at 45° C. to 50° C. After the reaction was over, palladium-carbon was removed by filtration, the filtrate was concentrated, and the residue was crystallized from acetonitrile to provide 20.7 g of Compound (1).

| | Elemental Analysis | | |
|---|---|---|---|
| | C | H | N |
| Calculated: | 65.61% | 8.45% | 3.56% |
| Found: | 65.55% | 8.36% | 3.55% |

SYNTHESIS EXAMPLE 2

Synthesis of Compound (17)

In 400 ml of isopropanol was suspended 58.3 g of a starting material [2-(4-dodecyloxybenzenesulfonamido)-4-methyl-6-nitro]phenylbenzyl ether obtained by nitrating Intermediate Product (A) obtained as in Synthesis Example 1 and after adding 2 g of ammonium chloride, 30 ml of water, and 50 g of reduced iron to the suspension, the mixture was refluxed for one hour under a nitrogen stream. After cooling, the reaction mixture was filtered through a Celite base and the filtrate was concentrated. To the residue was added a mixture of 200 ml of tetrahydrofuran and 100 ml of pyridine and after adding thereto 36 g of 4-dodecyloxybenzenesulfonyl chloride under a nitrogen stream, the resultant mixture was stirred for 2 hours at room temperature. Then, by applying a post treatment and a hydrogenation to the reaction product as in Synthesis Example 1, 64 g of Compound (17) was obtained, Mp: 152°~3° C.

| | Elemental Analysis | | |
|---|---|---|---|
| | C | H | N |
| Calculated: | 65.61% | 8.45% | 3.56% |
| Found: | 65.63% | 8.43% | 3.49% |

SYNTHESIS EXAMPLE 3

Synthesis of Compound (3)

In 500 ml of acetonitrile were dissolved 54.5 g of m-aminophenol and 40 ml of pyridine and the resulting solution was heated to 60° C. with stirring. After gradually adding dropwise 88.3 g of benzenesulfonyl chloride to the solution, the mixture was heated to the same temperature for 2 hours. Then, after allowing to cool the reaction mixture thus obtained, the product was extracted with a mixture of hexane and ethyl acetate and the extract was washed with a diluted hydrochloric acid aqueous solution and then a sodium chloride aqueous solution and then dried using Glauber's salt. After filtering, the filtrate was concentrated to provide 115 g of crystals of m-benzenesulfonamidophenol.

To 100 ml of dichloroethane were added 12.5 g of m-benzenesulfonamidophenol and 13.3 g of aluminum chloride and the resultant mixture was heated to 60° C. with stirring. To the mixture was added dropwise a solution of 3.6 ml of acetyl chloride dissolved in dichloroethane over a period of 2 hours followed by further heating to the same temperature for 2 hours. After allowing to cool, the mixture was placed in a hydrochloric acid acqueous solution and extracted with ethyl acetate. The extract was dried, concentrated and recrystallized from a mixture of hexane and ethyl acetate to provide 8.5 g of 4'-hydroxy-2'-benzenesulfonamidoacetophenone.

In 30 ml of water were dissolved 6 g of 4'-hydroxy-2'-benzenesulfonamidacetophenone and 5.9 g of potassium hydroxide and the resulting solution was maintained at 5° C. with stirring. To the solution was gradually added 30 ml of a diazonium salt aqueous solution of 5° C. prepared from 3.8 g of sulfanilic acid and 1.6 g of sodium nitrite by an ordinary manner to provide an azo dye aqueous solution. When the solution was heated to 70° C. and 15 g of sodium hydrosulfite was gradually added thereto, the dye was reduced to lose the color. The system was cooled and crystals thus precipitated were collected by filtration, washed with water, and dried to provide 3.8 g of 5'-amino-4'-hydroxy-2'-benzenesulfonamidoacetophenon.

In 30 ml of pyridine was dissolved 3.3 g of 5'-amino-4'-hydroxy-2'-benzenesulfonamidoacetophenon and while stirring the solution, 5.0 g of 4-octadecyloxybenzenesulfonyl chloride was added to the solution. After stirring the mixture for one hour, the mixture was poured in a hydrochloric acid aqueous solution and crystals thus precipitated were collected by filtration and recrystallized from acetonitrile using activated carbon to provide 4.7 g of Compound (20). Melting point 108° to 109° C.

| | Elemental Analysis | | |
|---|---|---|---|
| | C | H | N |
| Calculated: | 63.84% | 7.61% | 3.92% |
| Found: | 64.05% | 7.50% | 3.76% |

The compounds of this invention can be incorporated into photographic layers of color photographic materials, such as silver halide emulsion layers, interlayers, etc., using known techniques for introducing couplers to silver halide emulsion layers. For example, the compound can be dispersed in an aqueous hydrophilic colloid solution as a solution in a high-boiling organic solvent such as a phthalic acid alkyl ester (e.g., dibutyl phthalate, dioctyl phthalate, etc.), a phosphoric acid ester (e.g., diphenyl phosphate, triphenyl phosphate, tricresyl phosphate, trioctyl phosphate, etc.), a citric acid ester (e.g., tributyl acetylcitrate, etc.), a benzoic acid ester (e.g., octyl benzoate, etc.), an alkylamide (e.g., diethyllaurylamide, etc.), a fatty acid ester (e.g., dibutoxyethyl succinate, dioctyl azelate, etc.), a trimesic acid ester (e.g., tributyl trimesate, etc.), etc., or a low-boiling organic acid having boiling point of about 30° C. to 150° C., such as a lower alkyl acetate (e.g., ethyl acetate, butyl acetate, etc.), ethyl propionate, secondary butyl alcohol, methyl isobutyl ketone, β-ethoxyethyl acetate, methyl Cellosolve acetate, etc. In this case, a mixture of the above-described high-boiling organic solvent and the low-boiling organic solvent may be used for dissolving the compound of this invention.

The color stain preventing agent exhibits a marked effect in preventing color stain in a silver halide color photographic material of the type forming color images by the oxidative coupling with an aromatic primary amine developing agent (e.g., a phenylenediamine derivative and an aminophenol derivative) in a color development process.

Magenta couplers such as a 5-pyrazolone coupler, a pyrazolobenzimidazole coupler, a cyanocumarone coupler, a open chain acylacetonitrile coupler, etc., yellow couplers such as acylacetamide coupler (e.g., a benzoyl acetanilide, a pivaloyl acetanilide, etc.), etc., and cyan couplers such as a naphthol coupler, a phenol coupler, etc., are used as color-forming couplers for color photographic materials of this type. These couplers can be rendered non-diffusible by introducing a hydrophobic group as a ballast group into the molecule or bonding a ballast group to the polymer chain thereof and such a non-diffusible coupler is preferably used in this invention.

The couplers may be four-equivalent or two-equivalent couplers with respect to silver ion. Also, colored couplers having a color correction effect or couplers releasing a development inhibitor as development progresses (the so-called DIR couplers) may be used in this invention.

Specific examples of magenta color couplers are described in U.S. Pat. Nos. 2,600,788; 2,983,608; 3,062,653; 3,127,269; 3,311,476; 3,419,391; 3,519,429; 3,558,319; 3,582,322; 3,615,506; 3,834,908; 3,891,445; West German Pat. No. 1,810,464; West German Patent Application (OLS) Nos. 2,408,665; 2,417,945; 2,418,959; 2,424,467; Japanese Patent Publication No. 66031/'65; Japanese Patent Publication (Unexamined) Nos. 20,826/'76; 58,922/'77; 129,538/'74; 74,027/'74; 159,336/'75; 42,121/'77; 74,028/'74; 60,233/'75; 26,541/'76; 55,122/'78, etc.

Specific examples of yellow color couplers are described in U.S. Pat. Nos. 2,875,057; 3,265,506; 3,408,194; 3,551,155; 3,582,322; 3,725,072; 3,891,445; West German Pat. No. 1,547,868; West German Patent Application (OLS) Nos. 2,219,917; 2,261,361; 2,414,006; U.K. Patent No. 1,425,020; Japanese Patent Publication No. 10,783/'76; Japanese Patent Publication (Unexamined) Nos. 26,133/'72; 73,147/'73; 102,636/'76; 6341/'75; 123,342/'75; 130,442/'75; 21,827/'76; 87,650/'75; 82,424/'77; 155,219/'77, etc.

Specific examples of the cyan color couplers are described in U.S. Pat. Nos. 2,369,929; 2,434,272; 2,474,293; 2,521,908; 2,895,826; 3,034,892; 3,311,476; 3,458,315; 3,476,563; 3,583,971; 3,591,383; 3,767,411; 4,004,929; West German Patent Application (OLS) Nos. 2,414,830; 2,454,329; Japanese Patent Publication (Unexamined) Nos. 59,838/'73; 26,034/'76; 5055/'73; 146,828/'76; 69,624/'77; 90,932/'77, etc.

Colored couplers which can be used in this invention are described in, for example, U.S. Pat. Nos. 3,476,560; 2,521,908; 3,034,892; Japanese Patent Publication Nos. 2016/'69; 22,335/'63; 11,304/'67; 32,461/'69; Japanese Patent Publication (Unexamined) Nos. 26,034/'76; 42,121/'77; and West German Patent Application (OLS) No. 2,418,959.

DIR couplers which can be used in this invention are described in, for example, U.S. Pat. Nos. 3,227,554; 3,617,291; 3,701,783; 3,790,384; 3,632,345; West German Patent Application (OLS) Nos. 2,414,006; 2,454,301; 2,454,329; U.K. Pat. No. 953,454; Japanese Patent Publication (Unexamined) Nos. 69,624/'77; 122,335/'74; Japanese Patent Publication No. 16,141/'76.

The color stain preventing agent of this invention is also useful for preventing the formation of color stain in the so-called diffusion transfer silver halide color photographic materials. Suitable dye image-forming compounds used for the color photographic material of this type include dye developing agents, dye-releasing redox compounds, DDR couplers, etc., and specific examples of these compounds are described in, for example, U.S. Pat. Nos. 4,053,312, 4,055,428; 4,076,529; 4,152,153; 4,135,929; Japanese Patent Publication (Unexamined) Nos. 149,329/'78; 104,343/'76; 46,730/'78; 130,122/'79; 3819/'78; Japanese Patent Publication (Unexamined) Nos. 12,641/'81; 16,130/'81; 16,131/'81, etc.

The compound of this invention may be used together with known color stain preventing agents such as, for example, a hydroquinone derivative, an aminophenol derivative, a gallic acid derivative, an ascorbic acid derivative, etc.

Specific examples of known color stain preventing agents are described in, for example, U.S. Pat. Nos. 2,360,290; 2,336,327; 2,403,721; 2,418,613; 2,675,314; 2,701,197; 2,704,713; 2,728,659; 2,732,300; 2,735,365; Japanese Patent Publication (Unexamined) Nos. 92,988/'75; 92,989/'75; 93,928/'75; 110,337/'75; 146,235/'77; Japanese Patent Publication No. 23,813/'75.

The photographic material of this invention may contain a ultraviolet absorbent in the hydrophilic colloid layers thereof. Examples of suitable ultraviolet absorbent which can be used in this invention are a benzotraizole compound substituted with an aryl group, a 4-thiazolidone compound, a benzophenone compound, a cinammic acid ester compound, a butadiene compound, a benzoxazole compound, and a ultraviolet absorbing polymer. These ultraviolet absorbents may be fixed in the foregoing hydrophilic colloid layers.

Furthermore, the photographic silver halide emulsions, the preparation methods for these emulsions, and photographic additives (or photographic elements) which can be used for the color photographic materials of this invention include those described in "Preparation of Emulsion and Type thereof", "Emulsion washing", "Chemical sensitization", "Antifoggants and stabilization", "Hardeners", "Supports", "Plasticizers and lubricants", "Coating aids", "Matting agents", "Sensitizers", "Spectral sensitizers", "Method for incorporation", "Absorbing and filter dyes", "Coating procedures", etc., in *Research Disclosure,* No. 176 (1978 December), pages 22–31.

A negative-positive process (as described in, for example, *Journal of the Society of Motion Picture and Television Engineers,* Vol. 61, 667–701 (1953); a color reversal process for obtaining dye positive images by forming negative silver images by development with a developer containing a black and white developing agent, performing at least one uniform exposure or other appropriate fogging treatment, and then color development; or a silver dye bleach process involving developing the photograhic silver halide emulsion layers containing dyes after image exposure to form silver images and bleaching the dyes using the silver images as the bleaching catalyst can employed for forming color images using the color photographic materials of this invention.

The color developer used in this invention generally comprises an alkaline aqueous solution containing a color developing agent. The color developing agents which can be used in this invention include known primary aromatic amine developing agents such as phenylenediamines (4-amino-N,N-diethylaniline, 3-methyl-4-amino-N,N-diethylaniline, 4-amino-N-ethyl-N-$\beta$-hydroxyethylaniline, 3-methyl-4-amino-N-ethyl-N-$\beta$-hydroxyethylaniline, 3-methyl-4-amino-N-ethyl-N-$\beta$-methanesulfoamidoethylaniline, 4-amino-3-methyl-N-ethyl-N-$\beta$-methoxyethylaniline, etc.), etc.

Other color developing agents which can be used in this invention are described in, for example, L. F. A. Mason, *Photographic Processing Chemistry,* pages 226–229, Focal Press, (1966), U.S. Pat. Nos. 2,193,015; 2,592,364; Japanese Patent Publication (Unexamined) No. 64,933/'73.

The color developer which can be used in this invention may further contain a pH buffer such as the sulfites, carbonates, borates and phosphates of alkali metals and an antifoggant or development inhibitor such as bromides, iodides, and organic antifoggants. Also, the color developers may contain, if desired, a water softener, preservatives such as hydroxylamine, etc.; organic solvents such as benzyl alcohol, diethylene glycol, etc.; development accelerators such as polyethylene glycol, quaternary ammonium salts, amines, etc.; dye-forming couplers; competitive couplers; auxiliary developing agents such as 1-phenyl-3-pyrazolidone, etc.; tackifiers; polycarboxylic acid chelating agents described in U.S. Pat. No. 4,083,723; the antioxidants described in West German Patent Application (OLS) No. 2,622,950, etc.

The photographic silver halide emulsion layers are usually bleached after color development. The breach process may be performed simultaneously with a fix processing or separately from a fix processing. Compounds of polyvalent metals such as iron (III), cobalt (III), chromium (VI), copper (II), etc.; peracids; quinones; nitroso compounds; etc., can be used in this invention as bleaching agents. For example, ferrocyanides; dichromates, organic complex salts of iron (III) or cobalt (III), for example, the complex salt of an aminopolycarboxylic acid such as ethylenediaminetetraacetic acid, nitrotriacetic acid, 1,3-diamino-2-propanoltetraacetic acid, etc., or an organic acid such as citric acid, tartaric acid, malic acid, etc.; persulfates, permanganates; nitrosophenol, etc., can be used. Of these compounds, potassium ferricyanide, sodium iron (III) ethylenediaminetetraacetic acid, and ammonium iron (III) ethylenediaminetetraacetic acid are particularly useful. The ethylenediaminetetraacetic acid iron (III) complex salts are useful in a bleach solution as well as in a bleach-fix or blix solution.

The bleach solution or blix solution may further contain the bleach accelerators described in U.S. Pat. Nos. 3,042,520; 3,241,966; Japanese Patent Publication Nos. 8506/'70; 8836/'70, etc., the thiol compounds described in Japanese Patent Publication (Unexamined) No. 65,732/'78, as well as other various additives.

When the present invention is employed in a diffusion transfer process, the color photographic material can be processed with a viscous developer.

A viscous developer is a liquid composition containing processing components necessary for the development of the silver halide emulsions and the formation of diffusion transfer dye images. The main solvent of the developer is water but it may contain a hydrophilic solvent such as methanol, methyl Cellosolve, etc. The processing composition contains an alkali in an amount sufficient to maintain the pH necessary for performing the development of silver halide emulsion layers and also neutralizing acids (e.g., a hydrohalogenic acid such as hydrobromic acid, etc., or a carboxylic acid such as acetic acid, etc.,) which is generated during development and color forming processings. The alkali used in this case, are alkali metal salts, alkaline earth metal salts, or amines such as lithium hydroxide, sodium hydroxide, potassium hydroxide, calcium hydroxide dispersion, tetramethyl ammonium hydroxide, sodium carbonate, trisodium phosphate, diethylamine, etc. It is preferred to contain a caustic alkali at a concentration maintaining the pH higher than about 12, preferably higher than 14 at room temperature. More preferably, the processing composition further contains a high molecular weight hydrophilic polymer such as polyvinyl alcohol, hydroxyethyl cellulose, sodium carboxymethyl cellulose, etc. These polymers are used for imparting a viscosity of higher than 1 poise, preferably about 500 to about 1,000 poise to the processing composition at room temperature.

The invention is explained in greater detail by the following examples.

EXAMPLE 1

Preparation of Film A

A baryta-coated paper support with polyethylene coatings on both surfaces thereof was coated with a blue-sensitive silver chlorobromide emulsion containing a yellow coupler, $\alpha$-pyvaloyl-$\alpha$-(2,4-dioxo-5,5'-dimethyloxazolidine-3-yl)-2-chloro-5-[$\alpha$-(2,4-di-tert-pentylphenoxybutanamido]acetanilide at a thickness of 3.0 $\mu$m as a first layer (coupler coverage of $0.646\times10^{-3}$ mole/m$^2$, silver coverage of $3.88\times10^{-3}$ mole/m$^2$, 70 mole% silver bromide, and 30 mole% silver chloride) and then a gelatin layer of 1.5 $\mu$m in thickness was coated on the first layer as a second layer. Furtherore, a gelatin composition containing a magenta coupler, 1-(2,4,6-trichlorophenyl)-3-[2-chloro-(5-tetradecanamido)-aniline]-5-pyrazolone was coated on the second layer at a thickness of 3.1 $\mu$m as a third layer (coupler coverage of $0.500\times10^{-3}$ mole/m$^2$) to provide Film A.

Preparation of Film B

By following the same procedure as used in preparing Film A except that the second layer contained 2,5-di-t-octyl-hydroquinone (hydroquinone coverage of $1.59\times10^{-4}$ mole/m$^2$), Film B was prepared.

Preparation of Films C–F

Film C

Same as Film A except that the second layer contained Compound (1) of this invention at a coverage of $1.59\times10^{-4}$ mole/m$^2$.

Film D

Same as Film A except that the second layer contained Compound (3) of this invention at a coverage of $1.59\times10^{-4}$ mole/m$^2$.

Film E

Same as Film A except that the second layer contained Compound (17) of this invention at a coverage of $1.59\times10^{-4}$ mole/m$^2$.

Film F

Same as Film A except that the second layer contained Compound (1) of this invention at a coverage of $8.0\times10^{-5}$ mole/m$^2$.

Each of Films A to F thus prepared was exposed through a wedge having a continuous density gradation and then processed as follows.

| Processing Step | | |
|---|---|---|
| Color Development | 3 min. 30 sec. | 33° C. |
| Blix Processing | 1 min. 30 sec. | 33° C. |
| Washing | 3 min. | 28–35° C. |

The compositions of the processing solutions used in the above processing were as follows.

| | |
|---|---|
| Color Developer | |
| Benzyl Alcohol | 15 ml |
| Diethylenetriamine Pentaacetate | 5 g |
| Potassium Bromide | 0.4 g |
| $Na_2SO_3$ | 5 g |
| $Na_2CO_3$ | 30 g |
| Hydroxylamine Sulfate | 2 g |
| 4-Amino-3-methyl-N—β-(methanesulfonamido)ethylaniline.3/2 $H_2SO_4.H_2O$ | 4.5 g |
| Water to make | 1000 ml |
| | pH 10.1 |
| Blix Solution | |
| Ammonium thiosulfate (70 wt % aq. soln.) | 150 ml |
| $Na_2SO_3$ | 3 g |
| Na Fe(EDTA) | 40 g |
| EDTA | 4 g |
| Water to make | 1000 ml |
| | pH 6.8 |

The density of the color image of each sample thus developed was measured using a green filter (magenta coloring density). The difference between the magenta density in the yellow maximum coloring density and the magenta density in the yellow minimum coloring density was measured, whereby magenta color mixing in the yellow coloring areas was determined. The results obtained are shown in Table 1 below.

TABLE 1

| Film No. | Compound Used | Amount (mole/m$^2$) | Color Mixing |
|---|---|---|---|
| A | — | — | 0.56 |
| B | 2,5-Di-t-octylhydroquinone | $1.59\times10^{-4}$ | 0.25 |
| C | Compound (1) | " | 0.17 |
| D | Compound (3) | " | 0.18 |
| E | Compound (17) | " | 0.17 |
| F | Compound (1) | $8.0\times10^{-5}$ | 0.21 |

In the above table, the lower the numerical value, the better the color mixing. Thus, it is clear that the compounds of this invention are excellent in preventing the occurrence of color mixing (color fog) and the use of a small amount thereof provides a sufficient effect.

EXAMPLE 2

Preparation of Film G

A baryta-coated paper support with polyethylene coatings on both surfaces was coated with a blue-sensitive silver chlorobromide emulsion containing a yellow coupler, α-pivaloyl-α-(2,4-dioxo-5,5'-dimethyloxazolidine-3-yl)-2-chloro-5-[α-(2,4-di-t-pentylphenoxy)-butanamido]acetanilide at a dry thickness of 3 μm (coupler coverage of $0.646\times10^{-3}$ mole/m$^2$, silver coverage of $3.88\times10^{-3}$ mole/m$^2$, 70 mole% silver bromide, 30 mole% silver chloride) and a gelatin layer was coated on the emulsion layer at a dry thickness of 1 μm to provide Film G.

Films H to K

By following the same procedure as the case of preparing Film G except that $0.01\times10^{-3}$ mole/m$^2$ of each of Compound (1), (2), (3), and (16) was added to the silver halide emulsion layer together with the foregoing yellow coupler, Films H to K were prepared.

Each film thus prepared was exposed through a wedge having a continuous grey density gradation and was processed in the same manner as in Example 1 except that the color development was performed for 3 minutes at 38° C. After processing, the yellow density of each sample was measured and the maximum density ($D_{max}$) and the minimum density ($D_{min}$) were determined. The results obtained are shown in Table 2 below.

TABLE 2

| Film No. | Compound Used | $D_{max}$ | $D_{min}$ |
|---|---|---|---|
| G | — | 2.13 | 0.25 |
| H | Compound (1) | 2.08 | 0.19 |
| I | Compound (2) | 2.07 | 0.21 |
| J | Compound (3) | 2.02 | 0.20 |
| K | Compound (16) | 2.05 | 0.19 |

From the above results, it can be seen that Films H to K using the compounds of this invention showed lower minimum density than that of Film G and shows improved color fog.

When the foregoing Films G to K (before exposure) were stored for 3 days under conditions of 50% relative humidity and 50° C. in temperature, exposed and processed as above, the reduction of the maximum density and the increase of the minimum density were observed on Film G but the changes of the maximum density and the minimum density in Films H to K were very slight.

EXAMPLE 3

Preparation of Film L

Film L was prepared by coating, in succession, the following silver halide emulsion layers and auxiliary layers on a triacetyl cellulose support.

First Layer: Low speed red-sensitive silver halide emulsion layer

In a mixture of 100 ml of tricresyl phosphate and 100 ml of ethyl acetate was dissolved 100 g of a cyan coupler, 2-(heptafluorobutylamido)-5-[2'-(2'',4''-di-t-aminophenoxy)butylamido]phenol, the solution was mixed with 1 kg of 10% —elatine aqueous solution and emulsified, and then 500 g of the thus obtained cyan coupler emulsion was mixed with 1 kg of a red-sensitive silver iodobromide emulsion (containing 70 g of silver and 60 g of gelatin, iodine content of 4.5 mole%), and the mixture was coated on the support at a dry thickness of 2 μm.

Second Layer: High speed red-sensitive silver halide emulsion layer

A mixture of 1 kg of the cyan coupler emulsion as used for the first layer and 1 kg of a high speed red-sensitive silver iodobromide emulsion (containing 70 g of silver and 60 g of gelatin, iodine content of 4.5 mole%) was coated on the first layer at a dry thickness of 2 μm.

Third Layer: Interlayer

In a mixture of 100 ml of dibutyl phthalate and 100 ml of ethyl acetate was dissolved 50 g of 2,5-di-t-octylhydroquinone, the solution was mixed with 1 kg of a 10% gelatin aqueous solution with stirring to provide an emulsion, 700 g of the emulsion thus obtained was mixed with 1 kg of a 10% gelatin aqueous solution, and the resultant mixture was coated on the layer at a dry thickness of 1.2 μm.

Fourth Layer: Low speed green-sensitive silver halide emulsion layer

A mixture of 500 g of the emulsion prepared in the same manner as in preparing the first layer except that 125 g of a magenta coupler 1-(2,4,6-trichlorophenyl)-3-[3-(2,4-di-t-amylphenoxyacetamido)benzamido]-5-pyrazolone was used and 1 kg of a green-sensitive silver iodobromide emulsion (containing 70 g of silver and 60 g of gelatin, iodine content of 2.5 mole%) was coated on the layer at a dry thickness of 2.0 μm.

Fifth Layer: High speed green-sensitive silver halide emulsion layer

A mixture of 1 kg of the magenta coupler emulsion as used for the fourth layer and 1 kg of a high speed green-sensitive silver iodobromide emulsion (containing 70 g of silver and 60 g of gelatin, iodine content of 2.5 mole%) was coated on the layer at a dry thickness of 2 μm.

Sixth Layer: Interlayer

A mixture of 700 g of the emulsion as used for the third layer and 1 kg of a 10% gelatin aqueous solution was coated on the foregoing layer at a dry thickness of 0.9 μm.

Seventh Layer: Yellow filter layer

A gelatin solution containing yellow colloidal silver was coated on the foregoing layer at a dry thickness of 1 μm.

Eighth Layer: Low speed blue-sensitive silver halide emulsion layer

A mixture of 800 g of the emulsion obtained in the same manner as in forming the first layer except that 70 g of a yellow coupler, α-pivaloyl-α-(1-benzyl-5-ethoxy-3-hydantoinyl)-2-chloro-5-dodecyloxycarbonylacetanilide was used and 1 kg of a blue-sensitive silver iodobromide emulsion (containing 70 g of silver and 60 g of gelatin, iodine content of 2.5 mole%) was coated on the foregoing layer at a dry thickness of 2.0 μm.

Ninth Layer: High speed blue-sensitive silver halide emulsion layer

A mixture of 1 kg of the emulsion as used for the eighth layer and 1 kg of a high speed blue-sensitive silver iodobromide emulsion (containing 70 g of silver and 60 g of gelatin, iodine content of 2.5 mole%) was coated on the foregoing layer at a dry thickness of 2.0 μm.

Tenth Layer: Second protective layer

A mixture of 1 kg of the emulsion as described for the third layer and 1 kg of a 10% gelatin aqueous solution was coated on the foregoing layer at a dry thickness of 1 μm.

Eleventh Layer: First protective layer

A 10% gelatin aqueous solution containing a fine grain silver iodobromide emulsion (grain size of 0.15 μm and iodine content of 1 mole%) which was not chemically sensitized was coated on the foregoing layer at a silver coverage of 0.3 g/m$^2$ and at a dry thickness of 1 μm.

Films M and N were also prepared in the same way as in the case of preparing Film L except that Compound (1) and (17) were used respectively in place of di-t-octylhydroquinone for the third layer, the sixth layer, and the tenth layer.

Each of foregoing Films L to N was exposed to red light through a wedge having a continuous grey density gradation and then subjected to the following reversal development.

| Step | Processing Time | Temperature |
|---|---|---|
| First Development | 6 min. | 38° C. |
| Washing | 2 min. | " |
| Reversal | 2 min. | " |
| Color Development | 6 min. | " |
| Adjustment | 2 min. | " |
| Bleach | 6 min. | " |
| Fix | 4 min. | " |
| Washing | 4 min. | " |
| Stabilization | 1 min. | Room temp. |
| Drying | | |

The compositions of the processing solutions used in the above processings were as follows.

| | |
|---|---|
| First Developer | |
| Water | 700 ml |
| Sodium Tetrapolyphosphate | 2 g |
| Sodium Sulfite | 20 g |
| Hydroquinone Monosulfonate | 30 g |
| Sodium Carbonate (monohydrate) | 30 g |
| 1-Phenyl-4-methyl-4-hydroxymethyl-3-pyrazolidone | 2 g |
| Potassium Bromide | 2.5 g |
| Potassium Thiocyanate | 1.2 g |
| Potassium Iodide (0.1% aq. soln.) | 2 ml |
| Water to make | 1 liter |
| Reversal Solution | |
| Water | 700 ml |
| Nitrilo-N,N,N—trimethylene phosphonic acid.6 Na salt | 3 g |
| Stannous Chloride (dihydrate) | 1 g |
| p-Aminophenol | 0.2 g |
| Sodium Hydroxide | 8 g |
| Glacial Acetic Acid | 15 ml |
| Water to make | 1 liter |

-continued

| | |
|---|---|
| Color Developer | |
| Water | 700 ml |
| Sodium Tetrapolyphosphate | 2 g |
| Sodium Sulfite | 7 g |
| Sodium Tertiary Phosphate (12.$H_2O$) | 36 g |
| Potassium Bromide | 1 g |
| Potassium Iodide (0.1% aq. soln.) | 90 ml |
| Sodium Hydroxide | 3 g |
| Citrazinic Acid | 15 g |
| N—Ethyl-N—(β-methanesulfomamido-ethyl)-3-methyl-4-aminoaniline. Sulfate | 11 g |
| Ethylenediamine | 3 g |
| Water to make | 1 liter |
| Adjustment Solution | |
| Water | 700 ml |
| Sodium Sulfite | 12 g |
| Ethylenediamine Tetraacetic Acid Sodium Salt (dihydrate) | 8 g |
| Thioglycerol | 0.4 ml |
| Glacial Acetic Acid | 3 ml |
| Water to make | 1 liter |
| Bleach Solution | |
| Water | 800 ml |
| Ethylenediamine Tetraacetic Acid Sodium Salt (dihydrate) | 2.0 g |
| Ammonium Iron (III) Ethylenediamine Tetraacetic Acid (dihydrate) | 120.0 g |
| Potassium Bromide | 100.0 g |
| Water to make | 1 liter |
| Fix Solution | |
| Water | 800 ml |
| Ammonium Thiosulfate | 80.0 g |
| Sodium Sulfite | 5.0 g |
| Sodium Hydrogen Sulfite | 5.0 g |
| Water to make | 1 liter |
| Stabilization Solution | |
| Water | 800 ml |
| Formaldehyde (37% by weight) | 5.0 ml |
| Fuji Dry Well (Trade Name: Wetting agent manufactured by Fuji Photo Film Co.) | 5.0 ml |
| Water to make | 1 liter |

The density of each of the developed films was measured using a red filter and the maximum color density ($D_{max}$) and the minimum color density ($D_{min}$) were measured. Also, the maximum color densities of the blue-sensitive layer and the green-sensitive layer were measured using a blue filter and a green filter, respectively. The results obtained are shown in Table 3 below.

TABLE 3

| | Red-sensitive Layer | | Green-Sensitive Layer | Blue-Sensitive Layer |
|---|---|---|---|---|
| Film No. | ($D_{max}$) | ($D_{min}$) | ($D_{max}$) | ($D_{max}$) |
| L | 2.98 | 0.43 | 2.63 | 2.85 |
| M | 2.89 | 0.37 | 2.58 | 2.80 |
| N | 2.85 | 0.38 | 2.57 | 2.79 |

From the above results, it can be seen that in using the compounds of this invention, the minimum density of the red-sensitive layer is reduced. This result shows that the color stain is prevented by the use of the compounds of this invention.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising a support and at least one silver halide emulsion layer on the support, said photographic material contains at least one compound selected from the group consisting of a substantially colorless phenol or naphthol derivative having a group which is not released by the displacement of the oxidation product of an aromatic primary amine at the 4-position of the phenol ring or the naphthol ring of the derivative and at least one sulfonamido group and at least one group selected from the group consisting of a sulfonamido group, an acylamino group, and a sulfonyl group at other positions of the phenol or naphthol ring.

2. The silver halide color photographic material as claimed in claim 1, wherein said compound is contained in the silver halide emulsion layer.

3. The silver halide color photographic material as claimed in claim 1, wherein the photographic material has at least one interlayer and said compound is contained in the interlayer.

4. The silver halide color photographic material as claimed in claim 3, wherein the silver halide emulsion layer contains said compound.

5. The silver halide color photographic material as claimed in claim 1, wherein the substantially colorless phenol or naphthol derivative is represented by the general formula (I)

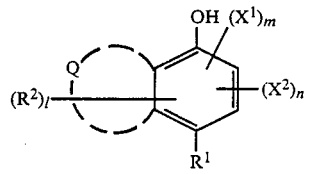

(I)

wherein $X^1$ and $X^2$ each represents a sulfonamido group, an acylamino group or a sulfonyl group; at least one of $X^1$ and $X^2$ is a sulfonamido group; $R^1$ represents a group which is not released by displacement of the oxidation product of an aromatic primary amine; $R^2$ represents a halogen atom, a cyano group, a nitro group, an alkyl group, an aryl group, a heterocyclic group, an alkoxy group, an aryloxy group, an alkylthio group, an arylthio group, a heterocyclic thio group, a carbamoyl group, an alkoxycarbonyl group, an acyl group, an alkoxycarbonylamino group, a ureido group, an amino group, a sulfinyl group, or the group represented by $X^1$ and $X^2$; l represents 0, 1 or 2; the ring having an OH group substituted thereto is a benzene ring or a naphthalene ring formed by the atomic group Q with the benzene ring; and m and n each represents an integer of 1 to 3.

6. The silver halide color photographic material as claimed in claim 1, wherein the substantially colorless phenol derivative is represented by the general formula (II)

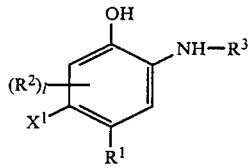

(II)

wherein $R^1$ represents a group which is not released by displacement of the oxidation product of an aromatic primary amine; $R^2$ represents a halogen atom, a cyano group, a nitro group, an alkyl group, an aryl group, a heterocyclic group, an alkoxy group, an aryloxy group, an alkylthio group, an arylthio group, a heterocyclic thio group, a carbamoyl group, an alkoxycarbonyl group, an acyl group, an alkoxycarbonylamino group, a ureido group, an amino group, a sulfinyl group, or the group represented by $X^1$ and $X^2$; l represents 0, 1, or 2; the ring having an OH group substituted thereto is a benzene ring or a naphthalene ring formed by the atomic group Q with the benzene ring; and m and n each represents an integer of 1 to 3, $X^1$ represents a sulfonamide group, an acylamino group or a sulfonyl group, and $R^3$ represents a sulfonyl group or an acyl group.

7. The silver halide color photographic material as claimed in claim 2, wherein said compound is present in an amount of about $5.0\times10^{-4}$ to about $5.0\times10^{-7}$ mole/$m^2$ per layer.

8. The silver halide color photographic material as claimed in claim 3, wherein said compound is present in an amount of about $5.0\times10^{-3}$ to about $5.0\times10^{-6}$ mole/$m^2$.

9. The silver halide color photographic material as claimed in claim 4, wherein said compound is present in the silver halide layer in an amount of about $5\times10^{-4}$ to about $5\times10^{-7}$ mole/$m^2$ and in the interlayer in an amount of about $5\times10^{-3}$ to about $5\times10^{-6}$ mole/$m^2$.

10. A silver halide color photographic material as claimed in claim 1, wherein the substantially colorless phenol derivative is represented by the general formula (III)

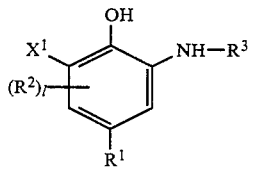

(III)

wherein $R^1$ represents a group which is not released by displacement of the oxidation product of an aromatic primary amine; $R^2$ represents a halogen atom, a cyano group, a nitro group, an alkyl group, an aryl group, a heterocyclic group, an alkoxy group, an aryloxy group, an alkylthio group, an arylthio group, a heterocyclic thio group, a carbamoyl group, an alkoxycarbonyl group, an acyl group, an alkoxycarbonylamino group, a ureido group, an amino group, a sulfinyl group, or the group represented by $X^1$ and $X^2$; l represents 0, 1, or 2; the ring having an OH group substituted thereto is a benzene ring or a naphthalene ring formed by the atomic group Q with the benzene ring; and m and n each represents an integer of 1 to 3, $X^1$ represents a sulfonamide group, an acylamino group or a sulfonyl group and $R^3$ represents a sulfonyl group or an acyl group.

11. A silver halide color photographic material as claimed in claim 5, wherein $R^1$ represents an alkyl group, an alkoxycarbonyl group, an acyl group, a carbamoyl group, a sulfamoyl group, a sulfonyl group, an aryl group, a heterocyclic group linked through a carbon atom, or substituted groups thereof.

* * * * *